United States Patent [19]

Castiglione

[11] Patent Number: 4,509,393

[45] Date of Patent: Apr. 9, 1985

[54] DRIVE ATTACHMENT FOR J-HOOK

[76] Inventor: Frank J. Castiglione, P.O. Box 651, Cape Coral, Fla. 33910

[21] Appl. No.: 472,115

[22] Filed: Mar. 4, 1983

[51] Int. Cl.[3] ..... B25B 13/48

[52] U.S. Cl. ..... 81/121.1; 81/124.7

[58] Field of Search ..... 81/90 C, 90 D, 121 A, 81/119

[56] References Cited

U.S. PATENT DOCUMENTS

| | | | |
|---|---|---|---|
| 1,181,565 | 5/1916 | Block | 81/121 A |
| 1,420,701 | 6/1922 | Hoffman | 81/121 A |
| 1,434,401 | 11/1922 | Mueller | 81/121 A |
| 2,522,428 | 9/1950 | Brunstad | 81/121 A |
| 2,642,105 | 6/1953 | Alliano | 81/121 A |
| 3,742,789 | 7/1973 | Rusk et al. | 81/90 C |
| 4,275,621 | 6/1981 | Mallott | 81/121 A X |

*Primary Examiner*—James G. Smith

*Attorney, Agent, or Firm*—Harvey B. Jacobson

[57] ABSTRACT

A pair of laterally spaced apart, registered and parallel plates are provided including two pairs of corresponding opposite side marginal edges. A pair of elongated parallel spacer members each extend along and are secured between a corresponding pair of side marginal edges of the plates to define an open ended sleeve of rectangular cross section wherein the spacing between the spacer members defines a major transverse inside dimension and the spacing between the plates defines a minor transverse inside dimension of the sleeve. The sleeve is open at its opposite ends and one end portion of a drive shank having a diameter substantially equal to the minor dimension of the housing is secured in one end thereof between the plates and against and paralleling the inner surface of one of the spacer members. The other end portion of the drive shank projects endwise outwardly from the sleeve and includes a free end including structure for releasably coupling a rotary torque tool thereto. The end of the shank secured within the sleeve terminates inwardly of the sleeve a spaced distance outwardly of the longitudinal mid-point of the sleeve. When a J-hook has its hooked end telescoped within the end of the sleeve remote from the drive shank and abutted against the latter the drive shank is automatically aligned with the threaded shank of the J-hook.

4 Claims, 6 Drawing Figures

FIG. 1
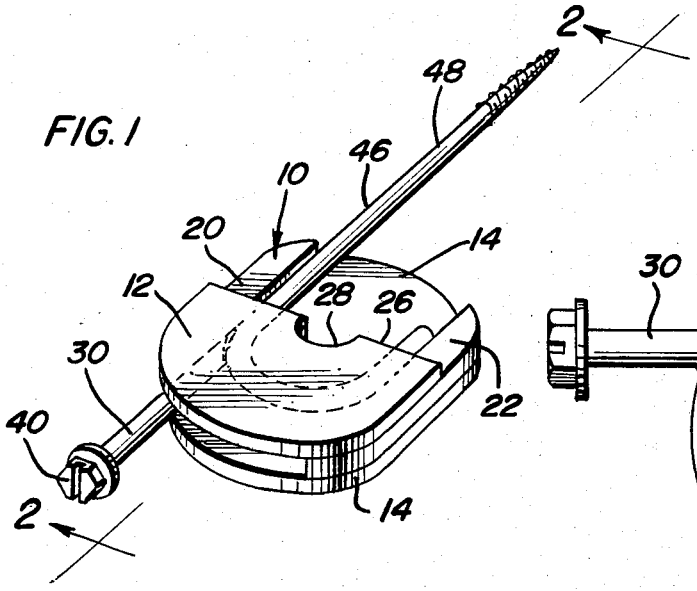
FIG. 6
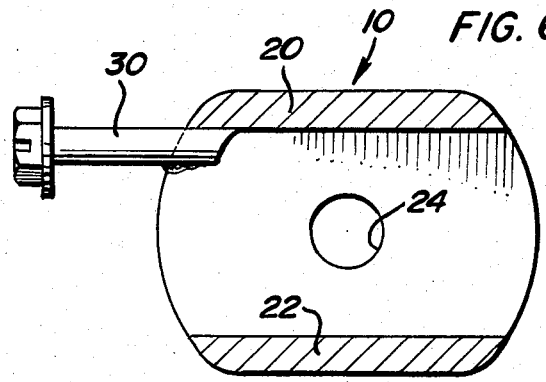
FIG. 2
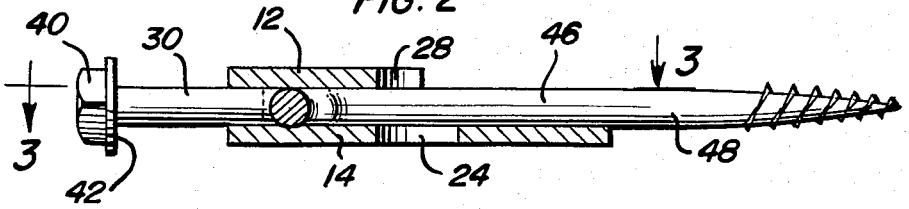
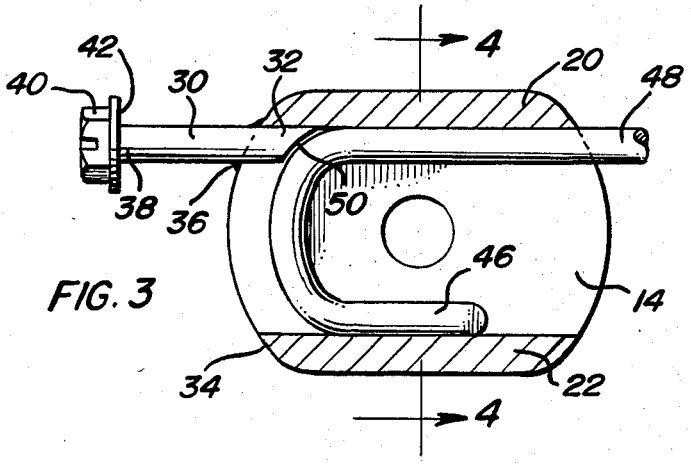
FIG. 3
FIG. 5
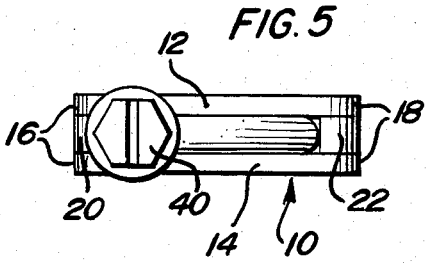
FIG. 4
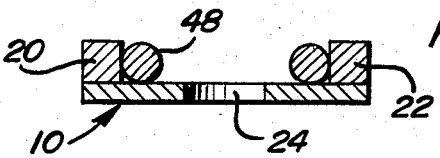

DRIVE ATTACHMENT FOR J-HOOK

BACKGROUND OF THE INVENTION

There are many instances in which a person may wish to install several or more J-hooks. Although such hooks may be installed by manually threading the threaded shank portions thereof into the desired support surfaces either with or without having pre-drilled a pilot bore therefor, such manual installation of J-hooks and the like is very tiring, especially if pre-drilled pilot bores are not used. Accordingly, a need exists for structure by which a J-hook may be threaded into a suitable support surface therefor either through the utilization of an electric drill or other rotary torque applying tool (either hand or motor driven).

Various different forms of attachments for driving J-hooks, L-hooks and anchor eyes heretofore have been provided. However, most of these attachments are relatively expensive to produce and are not specifically designed to provide a rotary driving shank with which a power rotary torque tool may be drivingly engaged and which is aligned with the threaded shank of the associated J-hook.

Examples of previously known forms of driving attachments including some of the general structural and operational features of the instant invention are disclosed in U.S. Pat. Nos. 295,880, 841,472, 855,905, 882,937, 2,437,762 and 4,275,621.

BRIEF DESCRIPTION OF THE INVENTION

The drive attachment of the instant invention includes a transversely narrow elongated sleeve of rectangular cross sectional shape. One end of a drive shank is telescoped into a first end of the sleeve between the major transverse dimension walls thereof and secured in position against the inner surface of one of the minor transverse dimension walls of the sleeve. The other end of the shank is equipped with structure by which a rotary torque tool may be drivingly coupled to the shank and the terminal end of the end portion of the shank secured within the sleeve terminates inwardly of the first end of the sleeve a distance spaced from the longitudinal mid-point of the sleeve and is bevelled toward the opposite side of the sleeve and the sleeve first end. The reversely turned end of a J-hook may be telescoped within the second end of the sleeve in abutting engagement with the shank end anchored within the sleeve. In this manner, the threaded shank of the J-hook is automatically aligned with the drive shank thereby enabling a rotary torque tool to be used effectively to thread the shank of the J-hook into a suitable support structure.

The main object of this invention is to provide an attachment to assist in threading the threaded shank of a J-hook into a suitable support structure.

Another object of this invention is to provide an attachment in accordance with the preceding object and which may be used in conjunction with a power screwdriver or drill as well as various types of hand wrenches adapted for imparting rotary torque to a threaded member.

Still another important object of this invention is to provide an attachment including a torque input shaft portion which is aligned with the threaded shank of an operatively associated J-hook.

A final object of this invention to be specifically enumerated herein is to provide a drive attachment for a J-hook which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the drive attachment of the instant invention and illustrating a J-hook operatively associated therewith;

FIG. 2 is an enlarged longitudinal vertical sectional view taken substantially upon the plane indicated by the sector line 2—2 of FIG. 1;

FIG. 3 is a horizontal sectional view taken substantially upon the plane indicated by the section line 3—3 of FIG. 2;

FIG. 4 is a transverse vertical sectional view taken substantially upon the plane indicated by the section line 4—4 of FIG. 3;

FIG. 5 is an end view of the assemblage illustrated in FIG. 1; and

FIG. 6 is a horizontal sectional view similar to FIG. 3, but with the J-hook removed.

DETAILED DESCRIPTION OF THE INVENTION

Referring now more specifically to the drawings the numeral 10 generally designates the one-piece drive attachment of the instant invention. The attachment 10 includes a pair of laterally spaced apart and registered parallel top and bottom plates 12 and 14 including pairs of corresponding opposite side marginal edges 16 and 18. A pair of elongated parallel spacer members 20 and 22 are interposed between and rigidly secured to the marginal edges 16 and 18, respectively, and the attachment 12 therefore defines an open-ended sleeve or hollow housing which is rectangular in cross sectional shape and includes major and minor inside transverse dimensions as measured between the spacer members 20 and 22 and between the plates 12 and 14, respectively.

The spacer members 20 and 22 may be secured between the plates 12 and 14 in any convenient manner such as by welding and the central portion of the plate 14 includes a circular opening 24 formed therethrough while the plate 12 is shorter than the plate 14 and includes an end edge 26 having a semi-circular notch 28 formed therein registered with the opening 24.

An elongated drive shank 30 is provided and includes a first end 32 snugly telescoped within the sleeve at one end 34 thereof and the first end of the shank 30 is abutted against and parallels the inner side of the spacer member 20. The shank 30 may be secured in position by welding 36. The second end 38 of the shank 30 includes a diametrically slotted hexagonal head 40 equipped with an integral washer 42. Thus, the second end 38 of the shank 30 may be readily engaged by a screwdriver shank or hexagonal socket for applying rotary torque thereto. Further, it will be noted that when a J-hook 46 constructed of cylindrical stock is snugly received between the panels or plates 12 and 14, the shank 48 of the J-hook 46 is aligned with the shank 30. Further, the innermost end of the J-hook 46 may be abutted against the end face 50 of the shank 30. The end face 50 is bevelled inwardly and toward the end 34 of the sleeve as may best be seen from FIG. 3 of the drawings.

If for some reason there is insufficient room to engage a screwdriver or power tool with the head 40, an elongated bar, screwdriver or blade or similar tool may be inserted partly through the opening 24 and recess 28 and used as a lever arm in order to apply rotary torque to the attachment 10. Further, it will be noted that the attachment 10 may be inexpensively constructed from readily available components such as plate, bar and rod stock and that the components of the attachment 10 may be readily assembled and secured relative to each other.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim as new is as follows:

1. A one-piece drive attachment for a J-hook, said attachment including an open-ended sleeve of rectangular inside transverse cross-sectional shape, said sleeve being defined by a pair of laterally spaced apart, registered and parallel opposite side plate portions including two pairs of corresponding opposite side marginal edges and a pair of elongated, parallel spacer portions each disposed between, extending along and rigidly interconnecting a corresponding pair of said side marginal edges, said sleeve defining a major inside transverse dimension between said spacer portions and a minor transverse dimension between said plate portions, an elongated drive shank of a diameter substantially equal to said minor transverse inside dimension, one end of said drive shank being telescoped within one end of said sleeve between said plate portions and positioned against and paralleling the inner surface of one of said spacer portions, said drive shank being rigidly secured to said sleeve, the other end of said drive shank projecting endwise outwardly from said one end of said sleeve, said one end of said drive shank terminating inwardly of said one end of said sleeve a spaced distance outwardly of the longitudinal mid-point of said sleeve, the free end of said other end of said shank including means adapted to have a rotary torque input tool removably coupled thereto, the other end of said sleeve being adapted to have the hooked end of a threaded shank-equipped J-hook slidingly telescoped therein, the end of one of said plate portions remote from said one end of said sleeve terminating appreciably inwardly of the corresponding end of the other plate portion, whereby an appreciable end portion of the inner surface of said other plate portion is exposed from the side of said sleeve partially closed by said one plate portion and may be used as a guide surface for assisting the manual insertion of the hooked end of a J-hook into said other end of said sleeve, said other plate portion having a central opening formed therethrough registered with a central portion of said end of said one plate portion remote from said one end of said sleeve, said opening and central portion being engageable between the thumb and forefinger of the user's hand to withdraw said sleeve from the hooked end of an installed J-hook, said one end of said drive shank comprising an abutment limiting telescoped engagement of the hooked end of a J-hook into said sleeve from said other end thereof, said one end of said drive shank terminating inwardly a spaced distance outward of said opening toward said one end of said sleeve.

2. The attachment of claim 1 wherein the terminal end of said one end portion of said shank is bevelled outwardly from said one spacer portion toward said one end of said sleeve.

3. The attachment of claim 1 wherein said means adapted to have a rotary torque input tool removably coupled thereto comprises a hexagonal head.

4. The assembly of claim 3 wherein said hexagonal head includes a diametric kerf therein.

* * * * *